US008710944B2

(12) United States Patent
Stautner et al.

(10) Patent No.: US 8,710,944 B2
(45) Date of Patent: Apr. 29, 2014

(54) SUPERCONDUCTING MAGNETIZER

(75) Inventors: Ernst Wolfgang Stautner, Niskayuna, NY (US); Kiruba Sivasubramaniam Haran, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 364 days.

(21) Appl. No.: 12/786,970

(22) Filed: May 25, 2010

(65) Prior Publication Data

US 2011/0133871 A1 Jun. 9, 2011

(51) Int. Cl.
*H01F 1/00* (2006.01)
*H01F 6/00* (2006.01)

(52) U.S. Cl.
USPC ..... 335/216; 62/51.1

(58) Field of Classification Search
USPC ..... 335/216, 296–300; 324/318; 62/51.1, 62/259.2, 268
See application file for complete search history.

(56) References Cited

U.S. PATENT DOCUMENTS

| | | | | |
|---|---|---|---|---|
| 3,801,843 | A | 4/1974 | Corman et al. | |
| 4,578,962 | A | 4/1986 | Dustmann | |
| 4,782,671 | A * | 11/1988 | Breneman et al. | 62/51.1 |
| 5,737,927 | A * | 4/1998 | Takahashi et al. | 62/51.1 |
| 6,140,719 | A | 10/2000 | Kalsi | |
| 6,173,761 | B1 * | 1/2001 | Chandratilleke et al. | 165/104.21 |
| 6,184,599 | B1 | 2/2001 | Okabe et al. | |
| 7,263,841 | B1 * | 9/2007 | Arman et al. | 62/51.1 |
| 7,443,066 | B2 | 10/2008 | Salamah et al. | |
| 7,728,592 | B2 * | 6/2010 | Ma et al. | 324/318 |
| 8,593,146 | B2 * | 11/2013 | Gao et al. | 324/318 |
| 2002/0070829 | A1 * | 6/2002 | Yanagi et al. | 335/216 |
| 2006/0166832 | A1 * | 7/2006 | Sugimoto et al. | 505/100 |
| 2006/0236709 | A1 | 10/2006 | Steinmeyer | |
| 2009/0212890 | A1 * | 8/2009 | Saho et al. | 335/216 |

FOREIGN PATENT DOCUMENTS

| | | | |
|---|---|---|---|
| DE | 102004061869 | A1 | 7/2006 |
| EP | 2081198 | A2 | 11/1984 |
| EP | 0144873 | A2 | 6/1985 |
| EP | 1154548 | A1 | 11/2001 |

OTHER PUBLICATIONS

Mike Fee, Michael P. Staines, Robert G. Buckley, Peter A. Watterson, and Jian Guo Zhu; "Calculation of AC Loss in an HTS Wind Turbine Generator"; IEEE Transactions on Applied Superconductivity, Vol. 13, No. 2, Jun. 2003; pp. 2193-2196.

K. Watanabe and S. Awaji; "Cryogen-Free Superconducting and Hybrid Magnets"; Journal of Low Temperature Physics, vol. 133, Nos. 1/2, Oct. 2003 (© 2003); pp. 17-30.

Ryoichi Hirose, Dr. Seiji Hayashi, Dr. Kazuyuki Shibutani; "Cryogen-free Superconducting Magnet"; Kobelco Technology Review No. 27 Nov. 2007; pp. 18-22.

European Search Report and Written Opinion issued in connection with corresponding EP Application No. 11166896.8, Jul. 31, 2012.

* cited by examiner

*Primary Examiner* — Bernard Rojas
(74) *Attorney, Agent, or Firm* — Ann M. Agosti

(57) ABSTRACT

A superconducting magnetizer includes a thermal shield disposed within a vacuum chamber. A superconducting magnet is disposed within the thermal shield and configured to generate a magnetic field in response to an electric current supplied to the superconducting magnet. A heat transfer device comprising at least one of a thermal conduction device, and a heat pipe is disposed contacting the superconducting magnet. A cryocooler is coupled to the heat transfer device and configured to cool the superconducting magnet via the heat transfer device.

17 Claims, 7 Drawing Sheets

SUPERCONDUCTING MAGNETIZER

BACKGROUND

The invention relates generally to magnetizers, and more specifically to a superconducting magnetizer for electrical machines such as motors, generators, or the like.

Typically a magnetizer (magnetizing pulse generator) includes a power supply for generating a DC current pulse. The electrical energy is drawn from large energy storage equipment, like a bank of capacitors. A switch capable of carrying very high currents is then closed to allow the magnetizing pulse to flow through the magnetizer coils.

An increasing number of large electrical machines utilize permanent magnet rotors to produce a rotating magnetic field linking stator windings mounted about the rotor. Conventionally resistive magnetizers are used to magnetize one or more of a plurality of permanent magnets. The magnetizer further includes a magnetizer head, and coils that form the electromagnetic poles of the magnetizer. The coils are energized to perform the magnetizing action of the magnetizer whereby a magnetic field flux is produced at least partially within the volumes occupied by the permanent magnets. The conventional resistive magnetizers have excess power supply requirements when using resistive systems, excess thermal management requirements during operation, and also complex cooling schemes.

For these and other reasons there is a need for the invention.

BRIEF DESCRIPTION

In accordance with one exemplary embodiment of the present invention, a superconducting magnetizer is disclosed. The superconducting magnetizer includes a thermal shield disposed within a vacuum chamber. A superconducting magnet is disposed within the thermal shield and configured to generate a magnetic field in response to an electric current supplied to the superconducting magnet. A heat transfer device comprising at least one of a thermal conduction device, and a heat pipe is disposed contacting the superconducting magnet. A cryocooler is coupled to the heat transfer device and configured to cool the superconducting magnet via the heat transfer device.

DRAWINGS

These and other features, aspects, and advantages of the embodiments of the present invention will become better understood when the following detailed description is read with reference to the accompanying drawings in which like characters represent like parts throughout the drawings, wherein.

Figure 11:
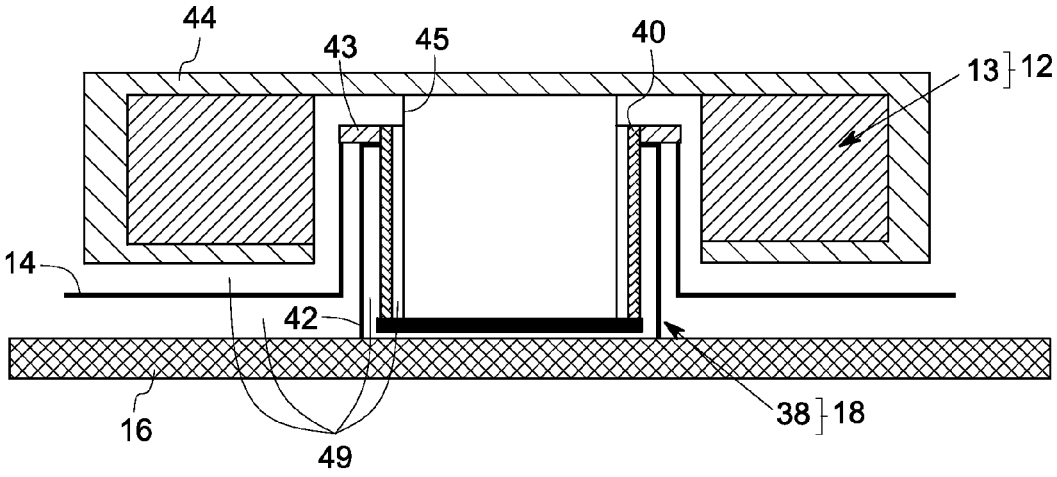
Figure 12:
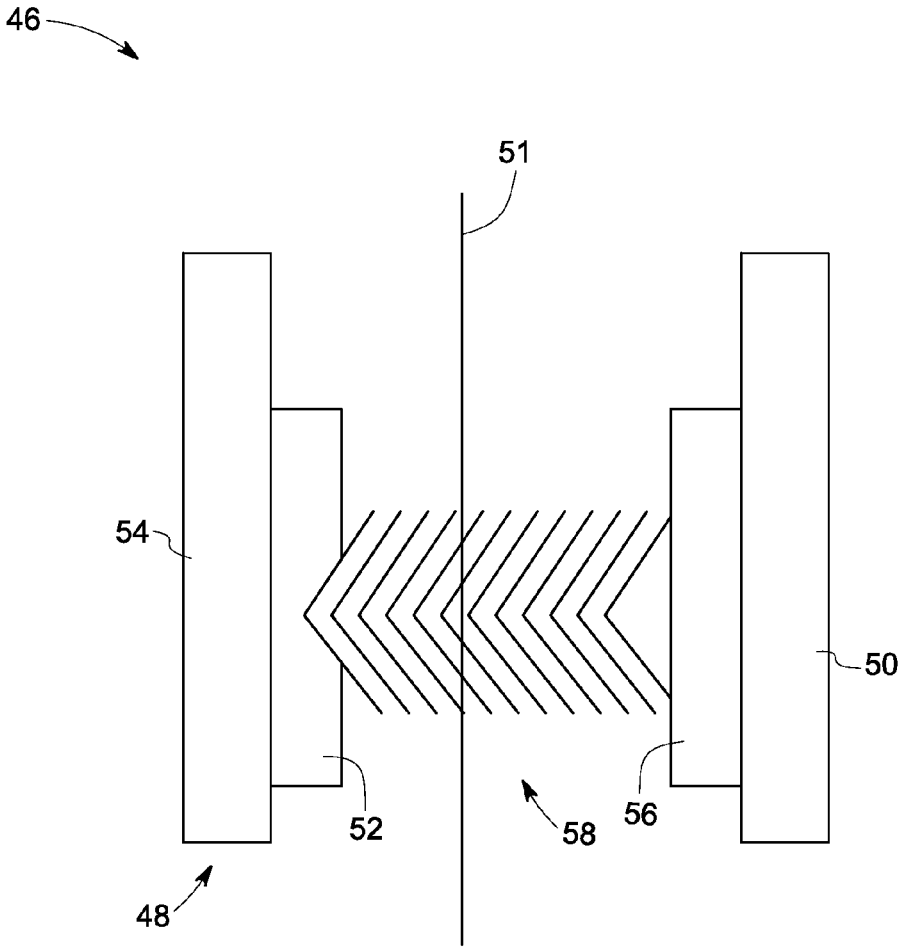

FIG. 11 is a diagrammatical representation of a support structure, for example, a nested tube arrangement for supporting a superconducting magnet, thermal shield in a superconducting magnetizer in accordance with an exemplary embodiment of the present invention; and FIG. 12 is a diagrammatical representation a support structure, for example a multilayer stack structure for supporting a superconducting magnet in a superconducting magnetizer in accordance with an exemplary embodiment of the present invention.

DETAILED DESCRIPTION

In accordance with the embodiments discussed herein, a superconducting magnetizer is disclosed. The superconducting magnetizer includes a thermal shield disposed within a vacuum chamber. A superconducting magnet is disposed within the thermal shield and configured to generate a magnetic field in response to an electric current supplied to the superconducting magnet. A heat transfer device including at least one of a thermal conduction device, and a heat pipe is disposed contacting the superconducting magnet. A cryocooler is coupled to the heat transfer device and configured to cool the superconducting magnet via the heat transfer device. The superconducting magnet, the thermal shield, or combinations thereof are supported against the vacuum chamber via a support device. The exemplary superconducting magnetizer has minimum power supply requirements, and minimum thermal management requirements during cool-down cycles.

Figure 1:
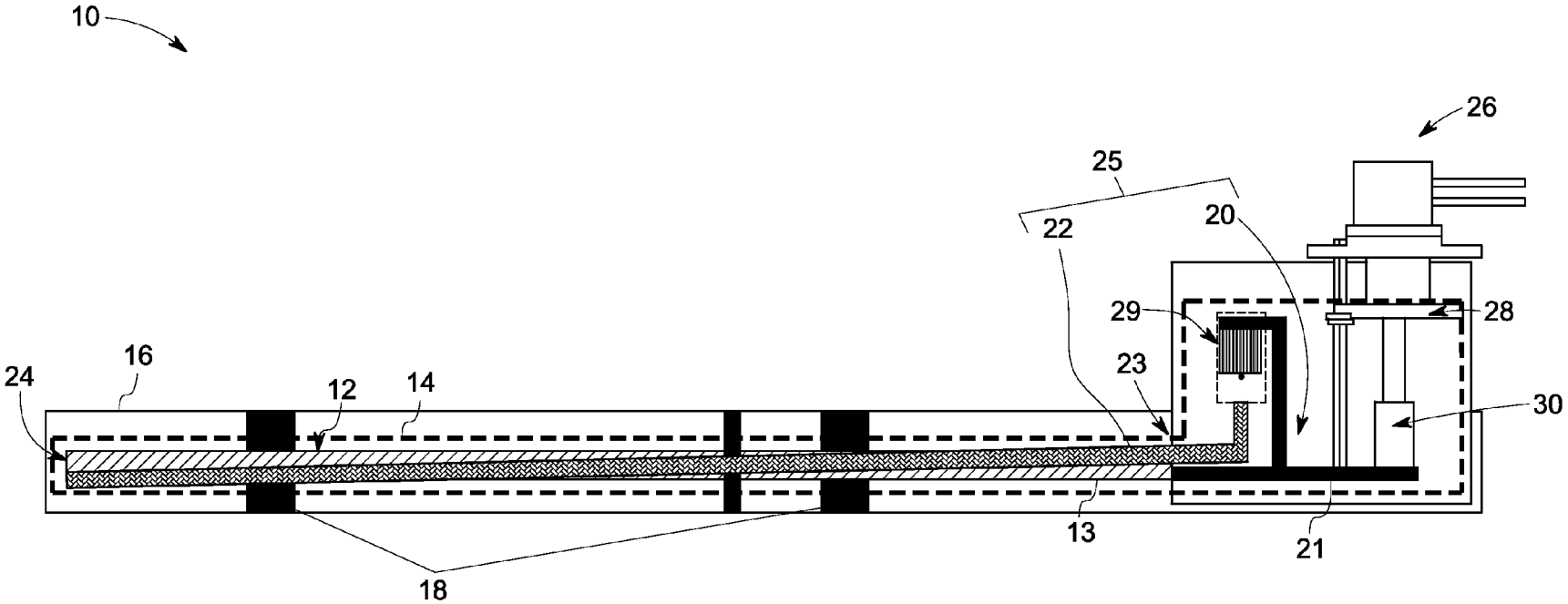
FIG. 1 is a diagrammatical representation of a superconducting magnetizer having a heat pipe in accordance with an exemplary embodiment of the present invention.

Referring to FIG. 1, a superconducting magnetizer 10 in accordance with an exemplary embodiment of the present invention is disclosed. In the illustrated embodiment, the magnetizer 10 has a superconducting magnet 12 for magnetizing a rotor of an electrical machine, for example a motor, generator, or the like. The superconducting magnet 12 includes a superconductive coil (not shown) and a magnet former 13. The superconductive coil is wound on the magnet former 13. A wire of the superconductive coil may be tape form, rectangular, or round shaped, or any other suitable shape. The superconducting magnet 12 is disposed within a thermal shield 14 provided within a vacuum chamber 16. The superconducting magnet 12 and the thermal shield 14 are supported against the vacuum chamber 16 via a support structure 18. It should be noted herein that the vacuum chamber 16 is a cartridge type vacuum chamber that can slide into a structure to facilitate the high magnetic field for the component that needs to be magnetized. The support structure 18 is explained in greater detail with reference to subsequent figures.

The superconducting magnet 12 includes a material that will conduct electricity with no electrical resistance. Most electrical conductors have some electrical resistance. However, electrical resistance is an undesirable property for a conductor to have because the electrical resistance consumes energy as heat. Superconductivity occurs in materials when the material is cooled below a critical temperature.

The superconducting magnet 12 for magnetizing a rotating electrical machine typically uses an electrical current flowing through the superconducting coil to produce a magnetic field. At ambient temperatures, the superconducting coil has a defined electrical resistance. However, when cooled below the critical temperature, the superconducting coil enters a superconducting state and loses its electrical resistance. The superconducting magnetizer 10 includes a race-track shaped superconducting magnet 12. In certain other embodiments, the magnet 12 may be circular, elliptical shape or pancake shaped. In some embodiments, the superconducting magnet includes niobium stannide, niobium-titanium, vanadium gallium, or combinations thereof. In the illustrated embodiment, a thermal conduction device 20 is disposed contacting the superconducting magnet 12. The illustrated thermal conduction device 20 includes a thermal bus 21 coupled to the superconducting magnet 12 for cooling the superconducting magnet 12 by thermal conduction. In the illustrated embodiment, the thermal bus 21 is rigidly coupled to the superconducting magnet 12.

A first heat pipe 22 is disposed in an inclined position extending from a cool end 23 to a warm end 24 of the superconducting magnet 12. The first heat pipe 22 transfers heat from the warm end 24 to the cool end 23 of the superconducting magnet 12 by heat pipe effect. The heat pipe effect refers to a technique of passive heat exchange based on natural convection, which circulates fluid without the necessity of a mechanical pump. Convective movement of the fluid starts when fluid in the first heat pipe 22 is heated at the warm end 24, causing it to expand and become less dense gas, and thus more buoyant than the cooler liquid in the cool end 23 of the first heat pipe 22. Convection moves heated gas to the cool end 23 in the first heat pipe 22 and simultaneously replaced by cooler liquid returning by gravity to the warm end 24 of the first heat pipe 22. The first heat pipe 22 is coupled to the superconducting magnet 12 beneath the thermal shield 14. The thermal conduction device 20 and the first heat pipe 22 together form a heat transfer device 25. In certain embodiments, more than one first heat pipe 22 may be used. In one embodiment, the heat transfer device 25 may include only first heat pipe 22. In another embodiment, the heat transfer device 25 may include only the thermal bus 21. In another embodiment, the heat transfer device 25 may include a combination of thermal bus 21 and the first heat pipe 22.

A cryocooler 26 is coupled to the thermal conduction device 20 to cool the superconducting magnet 12 below a critical temperature via the thermal conduction device 20 by thermal conduction. The cryocooler 26 is a refrigeration device used to attain cryogenic temperatures by cycling gases. The cryocooler 26 may have a plurality of stages. In the illustrated embodiment, the cryocooler 26 is a dual-stage cryocooler, namely first stage 28, and a second stage 30. The first heat pipe 22 is coupled to the thermal bus 21 via a condensing unit 29 (e.g., liquefaction cup with fins). As discussed previously, the first heat pipe 22 cools the magnet 12 by heat pipe effect. The thermal bus 21 is provided for transferring heat load from the superconducting magnet 12 to the cryocooler 26 by thermal conduction. The distance between thermal bus 21 and the magnet 12 is optimized for the minimum magnet fringe field so that the performance of the cryocooler 26 does not degrade during ramping.

Figure 2:
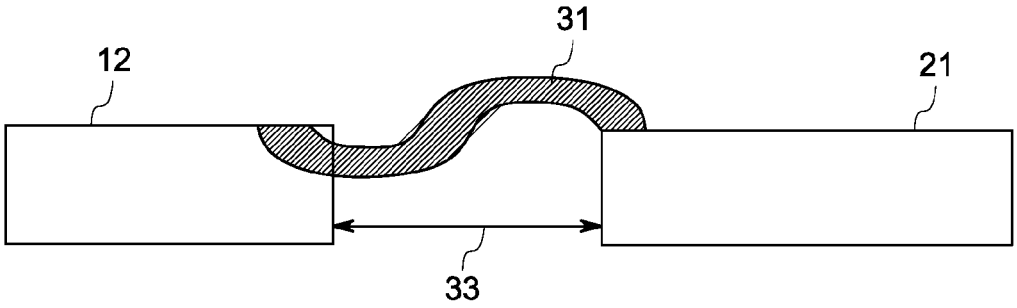
FIG. 2 is a diagrammatical representation of a superconducting magnet coupled to a thermal bus via a flexible link in accordance with an exemplary embodiment of the present invention.

Referring to FIG. 2, the thermal bus 21 and the superconducting magnet 12 are illustrated. In the illustrated embodiment, the thermal bus 21 is coupled to the superconducting magnet 12 via a flexible link 31. The illustrated flexible link 31 is a S-shaped link. Other types of flexible links are also envisaged. In one embodiment, the flexible link 31 includes a plurality of thin highly conducting copper or aluminum sheets stacked on top of each other. In another embodiment, the flexible link 31 includes flexible copper braids. In yet another embodiment, the flexible link 31 includes an aluminum litz wire. In yet another embodiment, the flexible link 31 includes stack of aluminum or copper strips. A gap 33 between the magnet 12 and the thermal bus 21 allows reduction in vibration and eddy current generation when the cryocooler 26 is directly mounted on the thermal bus 21.

Figure 3:
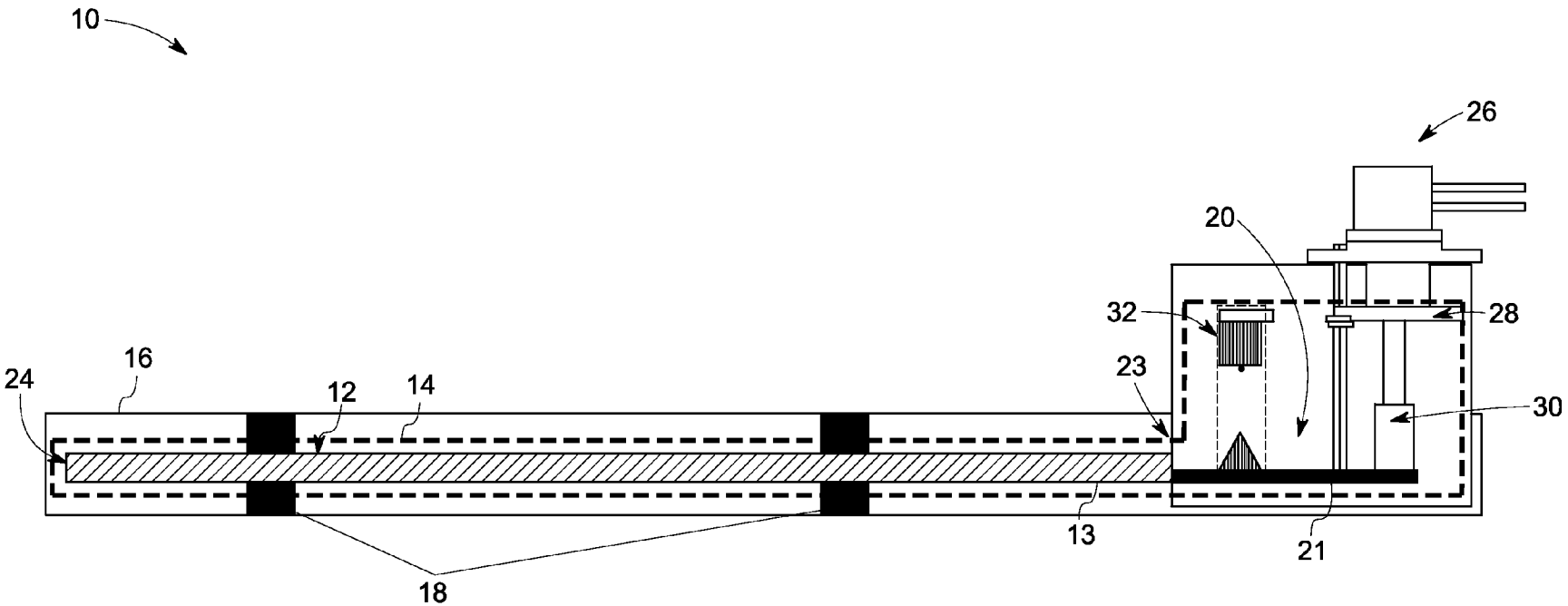
FIG. 3 is a diagrammatical representation of a superconducting magnetizer having another heat pipe in accordance with an exemplary embodiment of the present invention.

Referring to FIG. 3, a superconducting magnetizer 10 in accordance with an exemplary embodiment of FIG. 1 is disclosed. In the illustrated embodiment, additionally, the first stage 28 of the cryocooler 26 is rigidly coupled to the thermal shield 14 to cool the thermal shield 14 by thermal conduction. In one embodiment, the thermal shield 14 is cooled to a temperature of approx. 40 degree Kelvin. In the illustrated embodiment, the first stage 28 of the cryocooler 26 is coupled via a second heat pipe 32 to the thermal shield 14 and the heat bus 21 to cool the superconducting magnet 12 from a room temperature to a predetermined cooling temperature by heat pipe effect. The second heat pipe 32 substantially reduces the cooling time for the superconducting magnetizer 10 during initial and subsequent cool-down cycle operations. The second heat pipe 32 is automatically deactivated when the superconducting magnet 12 is cooled to the predetermined temperature during initial and subsequent cool-down cycle operations.

In accordance with the embodiments discussed with reference to FIGS. 1 and 3, thermal heat transfer between the cryocooler 26 and the superconducting magnet 12 is facilitated via the thermal conduction device 20, and heat pipes 22, 32. Moreover, the magnetizer 10 does not require cryogenic coolants (cryo-free) for cooling the superconducting magnet 12. Such cooling of the superconducting magnet 12 facilitates fast ramp up/down of the magnetizer 10, thereby minimizing eddy current heating and thus the thermal budget. The superconducting magnet 12 comprises a superconducting alloy including niobium stannide, niobium-titanium, vanadium-gallium, or combinations thereof. The superconducting wire is chosen such that the magnet 12 can be energized with minimum hysteresis losses.

Figure 4:
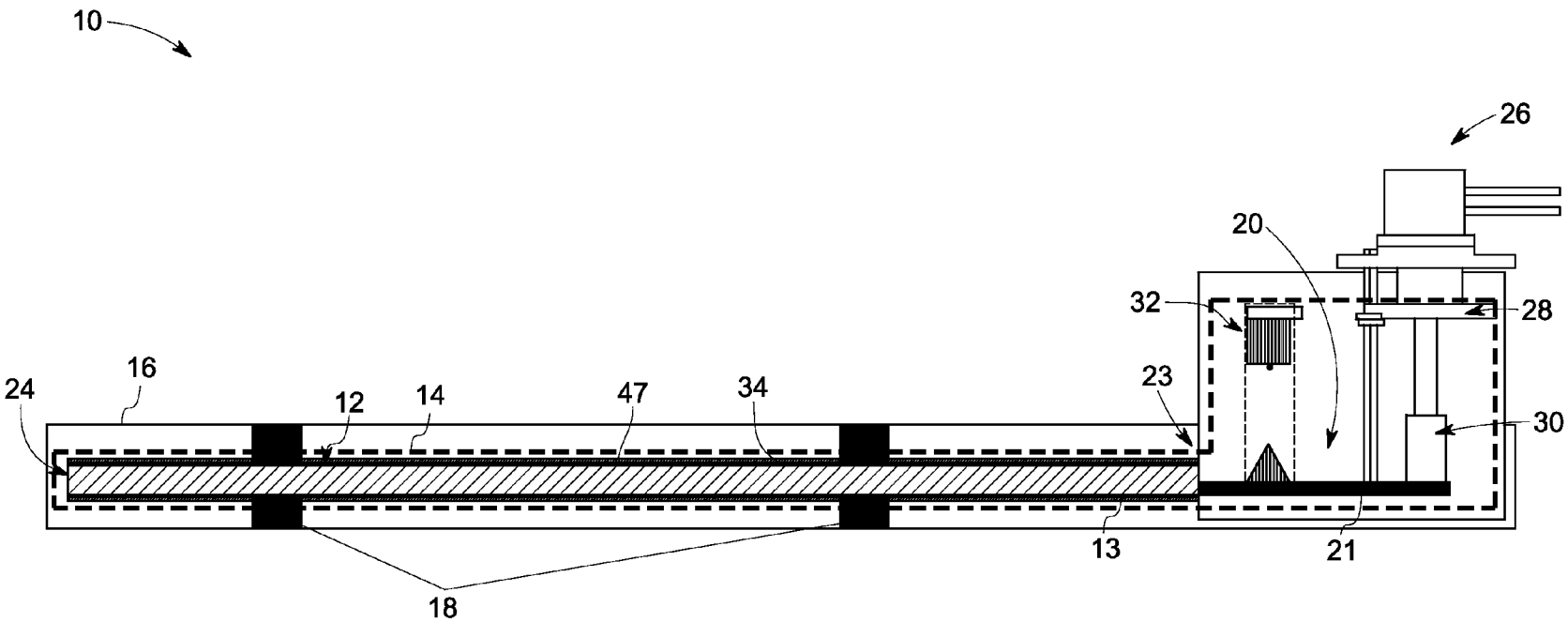
FIG. 4 is a diagrammatical representation of a superconducting magnetizer having an electrically non-conductive coating disposed on a magnet former in accordance with an exemplary embodiment of the present invention.

Referring to FIG. 4, a superconducting magnetizer 10 in accordance with an exemplary embodiment of FIG. 3 is disclosed. In the illustrated embodiment, additionally, the superconducting magnet 12 includes an electrically non-conductive coating 34 disposed on a magnetic former 13. The non-conductive coating 34 prevents shorting out of the superconducting windings. In one embodiment, the non-conductive coating 34 includes aluminum oxide or like disposed on the magnet former 13. In certain embodiments, the superconducting magnet 12 may include an electrically insulated, thermally conductive litz wire 47 disposed on the magnet former 13 after winding and before wire reaction and cryogenic epoxy vacuum impregnation process for improved heat transport and minimized eddy current losses.

One issue in thermal management of the superconducting magnet 12 is the temperature difference between the cool end 23 and the warm end 24 of the superconducting magnet 12. The temperature difference between the cool end 23 and the warm end 24 of the superconducting magnet 12 should be minimized for the superconducting magnet 12 to operate optimally in its design space. In the illustrated embodiment, Litz wire efficiently transfers heat from the warm end 24 to the cool end 23 and does not generate large eddy currents losses during ramping.

Figure 5:
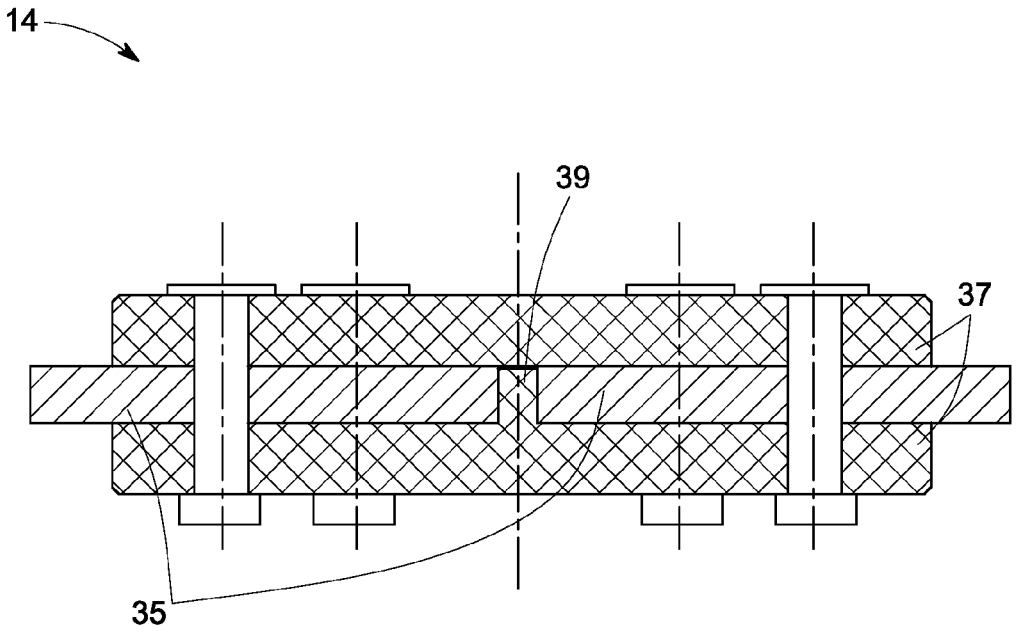
FIG. 5 is diagrammatical representation of a slotted thermal shield of a superconducting magnetizer in accordance with an exemplary embodiment of the present invention.

Referring to FIG. 5, the thermal shield 14 in accordance with an exemplary embodiment of the present invention is disclosed. In the illustrated embodiment, the thermal shield 14 includes a plurality of aluminum strips 35 sandwiched between G10 strips 37. The G10 strips 37 are riveted onto the plurality of aluminum strips 35. In certain other embodiments, the G10 strips 37 may be bolted or glued to the plurality of aluminum strips 35. Other bonding/attaching techniques are also envisaged. It should be noted herein that the aluminum strips 35 do not contact each other. The aluminum strips 35 are separated from each other via a projection 39 of the lower G10 strip 37 to prevent generation of eddy current loop. The aluminum strips 35 acts as a means for transfer of heat. Such a configuration provides flexibility and prevents plastic deformation of the thermal shield 14.

Figure 6:
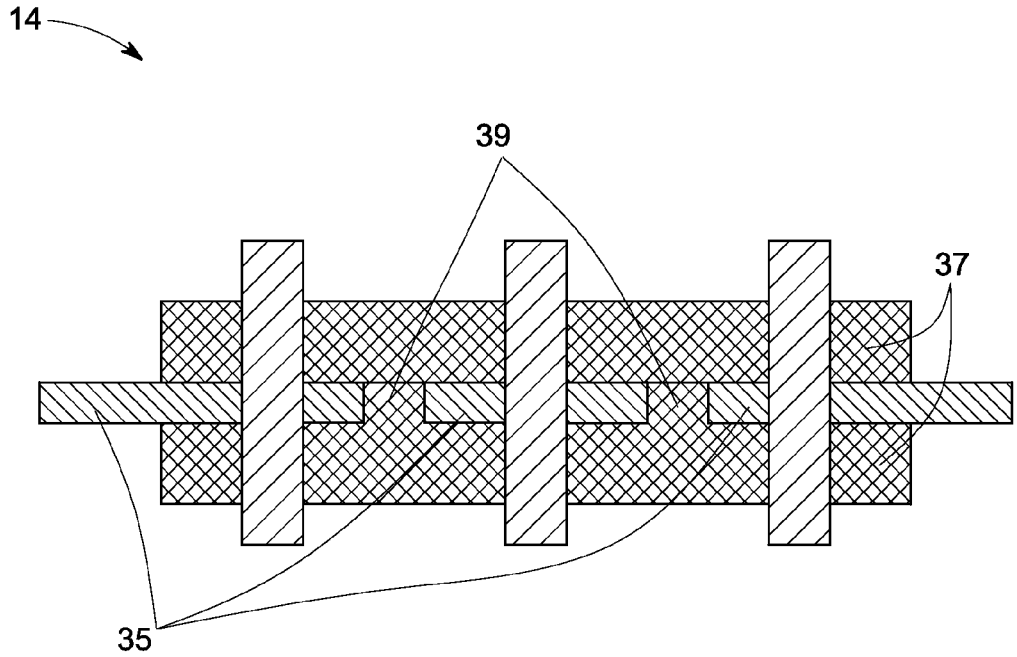
FIG. 6 is diagrammatical representation of a slotted thermal shield of a superconducting magnetizer in accordance with an exemplary embodiment of the present invention.

Referring to FIG. 6, the thermal shield 14 similar to the previous embodiment of the present invention is disclosed. In the illustrated embodiment, the thermal shield 14 includes the plurality of aluminum strips 35 sandwiched between G10 strips 37. The G10 strips 37 are riveted or bolted onto the plurality of aluminum strips 35. The aluminum strips 35 are separated from each other via a projection 39 of the G10 strip 37 to prevent generation of eddy current loop.

Figure 7:
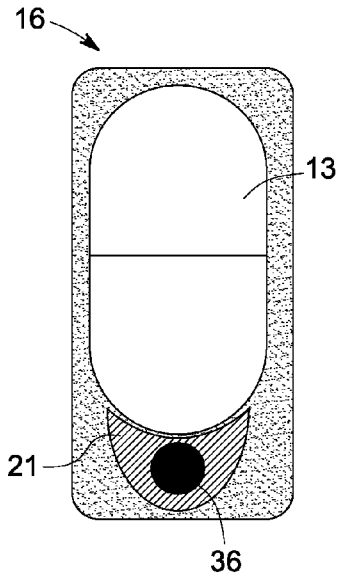
FIG. 7 is a diagrammatical representation of an arrangement of a thermal bus and coldhead in a superconducting magnetizer in accordance with an exemplary embodiment of the present invention.

Referring to FIG. 7, an arrangement of the thermal bus 21 and the coldhead 36 of the cryocooler for efficient cooling of the superconducting magnet is disclosed. As disclosed previously, the superconducting magnet former 13 is located in the vacuum chamber 16. The thermal bus 21 is indicated by the hatched portion and located proximate to the magnet former 13 in the vacuum chamber 16. The thermal bus 21 is coupled to the coldhead 36 of the cryocooler and configured to facilitate cooling of the superconducting magnet by thermal conduction.

Figure 8:
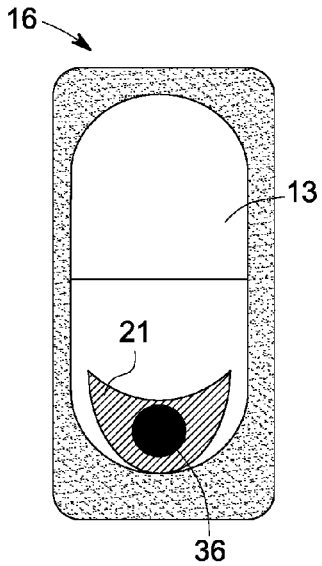
FIG. 8 is a diagrammatical representation of an arrangement of a thermal bus and coldhead in a superconducting magnetizer in accordance with an exemplary embodiment of the present invention.

Referring to FIG. 8, an arrangement of the thermal bus 21 and the coldhead 36 of the cryocooler for efficient cooling of the superconducting magnet is disclosed. In the illustrated embodiment, the thermal bus 21 is located on the magnet former 13 in the vacuum chamber 16. The thermal bus 21 is coupled to the coldhead 36 of the cryocooler and configured to facilitate cooling of the superconducting magnet by thermal conduction.

Figure 9:
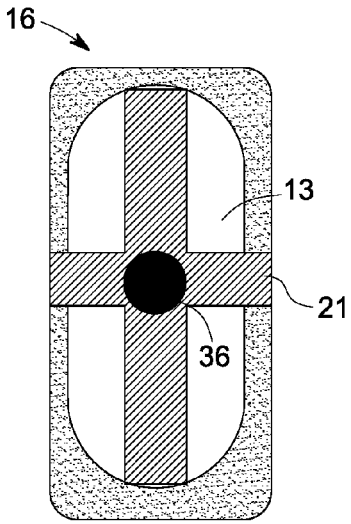
FIG. 9 is a diagrammatical representation of an arrangement of a thermal bus and coldhead in a superconducting magnetizer in accordance with an exemplary embodiment of the present invention.

Referring to FIG. 9, an arrangement of the thermal bus 21 and the coldhead 36 of the cryocooler for efficient cooling of the superconducting magnet is disclosed. In the illustrated embodiment, the thermal bus 21 is located on the magnet former 13 in the vacuum chamber 16. Compared to the previous embodiment of FIG. 8, in the illustrated embodiment, the thermal bus 21 is disposed extending along four different direction on the magnet former 13. The thermal bus 21 is coupled to the coldhead 36 of the cryocooler and configured to facilitate enhanced cooling of the superconducting magnet by thermal conduction.

Figure 10:
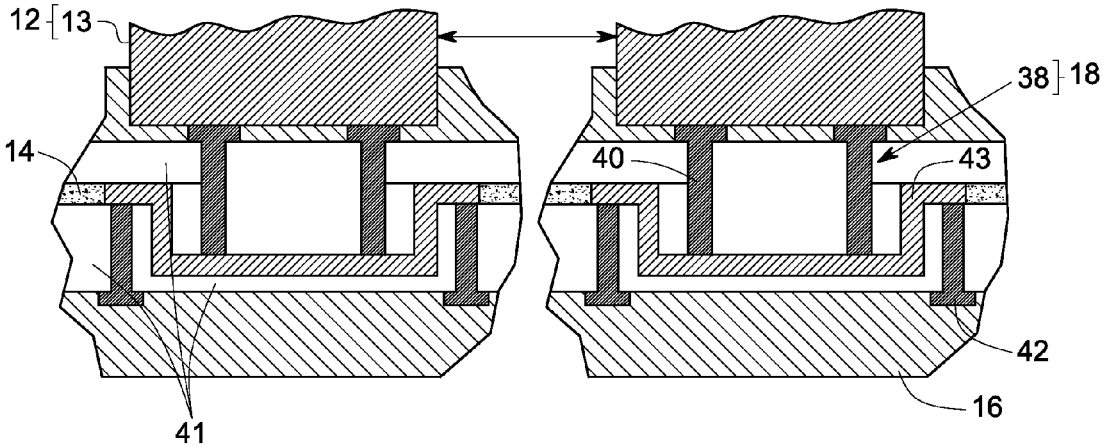
FIG. 10 is a diagrammatical representation of a support structure, for example, a nested tube arrangement for supporting a superconducting magnet, thermal shield in a superconducting magnetizer in accordance with an exemplary embodiment of the present invention.

Referring to FIG. 10, the support structure 18 for supporting the superconducting magnet 12 and the thermal shield 14 is disclosed. As disclosed previously, the superconducting magnet 12 and the thermal shield 14 are supported against the vacuum chamber 16 via the support structure 18. In the illustrated embodiment, the support structure 18 includes a nested tube arrangement 38 coupled to the superconducting magnet former 13 and configured to support the former 13 against the vacuum chamber 16. Each nested tube arrangement 38 includes an inner tube 40 disposed inside an outer tube 42. The inner tube 40 is disposed linking the former 13 and a thermal shield link 43. The outer tube 42 is disposed linking the thermal shield link 43 and the vacuum chamber 16. In another exemplary embodiment, the nested tube arrangement 38 may have more than two tubes disposed in a nested manner. In certain embodiments, the number of nested tube arrangements 38 may also vary depending on the application. The reference numeral 41 indicates vacuum regions in the support structure 18.

Referring to FIG. 11, the support structure 18 for supporting the superconducting magnet 12 and the thermal shield 14 is disclosed. As disclosed in the previous embodiment, the superconducting magnet 12 and the thermal shield 14 are supported against the vacuum chamber 16 via the support structure 18. In the illustrated embodiment, the support structure 18 includes the nested tube arrangement 38 coupled to a clamp shell 44 disposed surrounding the superconducting magnet former 13 and configured to support the former 13 against the vacuum chamber 16. The nested tube arrangement 38 includes the inner tube 40 disposed inside the outer tube 42. The illustrated nested tube arrangement 38 further includes another inner tube 45 disposed inside the inner tube 40. The inner tube 45 is disposed linking the clamp shell 44 and the thermal shield link 43. The reference numeral 49 indicates vacuum regions in the support structure 18. In accordance with embodiments disclosed with reference to FIGS. 10 and 11, the components disposed in the vacuum chamber are capable of withstanding the large magnetic forces of several 100 kN when energizing the superconducting magnet 12. The support structure 18 facilitates the components to withstand high mechanical and low thermal loads. It should be noted herein that compared to the embodiment of FIG. 10, in the illustrated embodiment, the built height is reduced. As a result, the magnet former 13 is disposed closer to a component that needs to be magnetized. In such an embodiment, a wire length required for the superconducting magnet 12 to achieve a high magnetic field, for example 10 Tesla, is reduced. The component is homogenously magnetized.

Referring to FIG. 12, an alternate support structure 46 for supporting a superconducting magnet 48 against a vacuum chamber 50 is disclosed. Similar to the previous embodiments, the superconducting magnet 48 is disposed within a thermal shield 51 provided within the vacuum chamber 50. In the illustrated embodiment, the support structure 46 includes one fixture block 52 coupled to a former 54 of the magnet 48 and another fixture block 56 coupled to the vacuum chamber 50. The support structure 46 includes a multilayer vacuum stack structure 58 disposed between the fixture blocks 52, 56. The multilayer stack structure 58 is a stack of bent V-shaped thin tapes and includes staybrite, tufnol, solid mylar, brass, or combinations thereof. The structure 58 has a substantially higher thermal contact resistance that enables to support higher compressive loads at cryogenic temperatures. When the superconducting magnet 48 is subjected to mechanical and thermal loads, the structure 58 is compressed, resulting in mutual contact of macroscopically flat surfaces of the structure 58. The mutual contact of the flat surfaces occurs only over limited regions. Such an embodiment is useful for supporting the magnet 48 against substantially larger forces and where the magnet 48 needs to be moved even substantially closer to a component to be magnetized.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A superconducting magnetizer, comprising:

a vacuum chamber;

a thermal shield disposed within the vacuum chamber;

a superconducting magnet disposed within the thermal shield and configured to generate a magnetic field in response to an electric current supplied to the superconducting magnet;

a heat transfer device comprising a thermal conduction device and at least one heat pipe disposed contacting the superconducting magnet; and a cryocooler coupled to the heat transfer device and configured to cool the superconducting magnet via the heat transfer device, wherein thermal conduction device comprises a thermal bus coupled to the cryocooler and the superconducting magnet, wherein the at least one heat pipe comprises a first heat pipe disposed in an inclined position contacting the superconducting magnet.

2. The superconducting magnetizer of claim 1, wherein the thermal bus is rigidly coupled to the superconducting magnet.

3. The superconducting magnetizer of claim 1, wherein the thermal bus is coupled to the superconducting magnet via a flexible link.

4. The superconducting magnetizer of claim 1, wherein the thermal bus is disposed proximate to a superconducting magnet former within the vacuum chamber and coupled to a coldhead of the cryocooler; wherein the thermal bus is configured to cool the superconducting magnet by thermal conduction.

5. The superconducting magnetizer of claim 1, wherein the thermal bus is disposed on a superconducting magnet former within the vacuum chamber and coupled to a coldhead of the cryocooler, wherein the thermal bus is configured to cool the superconducting magnet by thermal conduction.

6. The superconducting magnetizer of claim 1, further comprising a condensing unit, wherein the first heat pipe is coupled to the thermal bus via the condensing unit and configured to cool the superconducting magnet using a heat pipe effect.

7. The superconducting magnetizer of claim 1, wherein the thermal shield is rigidly coupled to one stage among a plurality of stages of the cryocooler to cool the thermal shield and the superconducting magnet by thermal conduction.

8. The superconducting magnetizer of claim 1, wherein the at least one heat pipe comprises a second heat pipe, wherein the thermal shield is coupled to another stage among a plurality of stages of the cryocooler via the second heat pipe to cool the thermal shield and the superconducting magnet by heat pipe effect during cool-down cycles of the superconducting magnetizer.

9. The superconducting magnetizer of claim 8, wherein the second heat pipe is automatically deactivated when the superconducting magnet is cooled to a predetermined temperature during cool-down cycles of the superconducting magnetizer.

10. The superconducting magnetizer of claim 1, wherein the superconducting magnet comprises a race-track type superconducting magnet.

11. The superconducting magnetizer of claim 1, wherein the superconducting magnet comprises niobium-stannide, niobium-titanium, vanadium-gallium, or combinations thereof.

12. The superconducting magnetizer of claim 1, wherein the thermal shield comprises a slotted thermal shield comprising a plurality of aluminum strips bonded between G10 strips in such a way that the aluminum strips do not contact each other.

13. The superconducting magnetizer of claim 1, further comprising a support device for supporting the superconducting magnet, the thermal shield, or combinations thereof against the vacuum chamber.

14. The superconducting magnetizer of claim 13, wherein the support structure comprises at least one nested tube arrangement coupled to a superconducting magnet former and configured to support the superconducting magnet against the vacuum chamber.

15. The superconducting magnetizer of claim 13, wherein the support structure comprises at least one nested tube arrangement coupled to a clamp shell disposed surrounding a superconducting magnet former and configured to support the superconducting magnet against the vacuum chamber.

16. The superconducting magnetizer of claim 13, wherein the support structure comprises a multilayer stack structure coupled to a superconducting magnet former and configured to support the superconducting magnet against the vacuum chamber.

17. The superconducting magnetizer of claim 16, wherein the multilayer stack structure comprises staybrite, tufnol, solid mylar, brass, or combinations thereof.

* * * * *